US005114002A

United States Patent [19]

Warner

[11] Patent Number: 5,114,002

[45] Date of Patent: May 19, 1992

[54] REINFORCED DISPLAY BOX

[75] Inventor: David M. Warner, Teaneck, N.J.

[73] Assignee: Universal Folding Box, Inc., Hoboken, N.J.

[21] Appl. No.: 709,285

[22] Filed: Jun. 3, 1991

[51] Int. Cl.[5] ..... B65D 5/06

[52] U.S. Cl. ..... 206/45.14; 206/45.19

[58] Field of Search ..... 206/45.14, 45.19, 45.31, 206/277, 485, 486

[56] References Cited

U.S. PATENT DOCUMENTS

| | | | |
|---|---|---|---|
| 2,946,433 | 7/1960 | Hennessey | 206/45.19 |
| 3,158,259 | 11/1964 | Pantalone | 206/45.14 |
| 3,252,566 | 5/1966 | Hanson | 206/45.14 |
| 3,270,867 | 9/1966 | Hennessey et al. | 206/45.14 |
| 3,424,299 | 1/1969 | Rosenburg, Jr. | 206/45.14 |
| 3,489,269 | 1/1970 | Rosenburg, Jr. | 206/45.14 |
| 3,543,919 | 12/1970 | Lewis et al | 206/45.14 |
| 3,570,658 | 3/1971 | Swanberg | 206/45.14 |
| 3,575,286 | 4/1971 | Rosenburg, Jr. | 206/45.14 |
| 3,669,253 | 6/1972 | Hanko | 206/45.14 |
| 3,684,085 | 8/1972 | Desmond | 206/45.14 |
| 3,741,380 | 6/1973 | Carney | 206/45.14 |
| 3,770,116 | 11/1973 | Cote | 206/45.14 |
| 3,887,067 | 6/1975 | Collura et al. | 206/45.14 |
| 4,037,717 | 7/1977 | Roccaforte | 206/45.14 |
| 4,109,786 | 8/1978 | Roccaforte | 206/45.14 |
| 4,117,924 | 10/1978 | Growney | 206/45.14 |
| 4,159,765 | 7/1979 | Roccaforte | 206/45.19 |
| 4,264,006 | 4/1981 | Swanberg | 206/45.14 |
| 4,424,897 | 1/1984 | Ondris et al. | 206/45.14 |
| 4,438,848 | 3/1984 | Montealegre et al. | 206/45.14 |
| 5,005,701 | 4/1991 | Dutcher | 206/45.14 |

*Primary Examiner*—Jimmy G. Foster

*Attorney, Agent, or Firm*—James & Franklin

[57] ABSTRACT

Rigidification of a display carton having shadow panels and an intermediate object-receiving partition is accomplished by providing for engagement between the shadow panels and the bottom wall of the container to fix the position of those panels, thereby to rigidify and reinforce the outer walls of the container, and with a strut active between the partition and one of the container walls to support the partition and wall in desired spaced relation.

24 Claims, 2 Drawing Sheets

FIG. 2
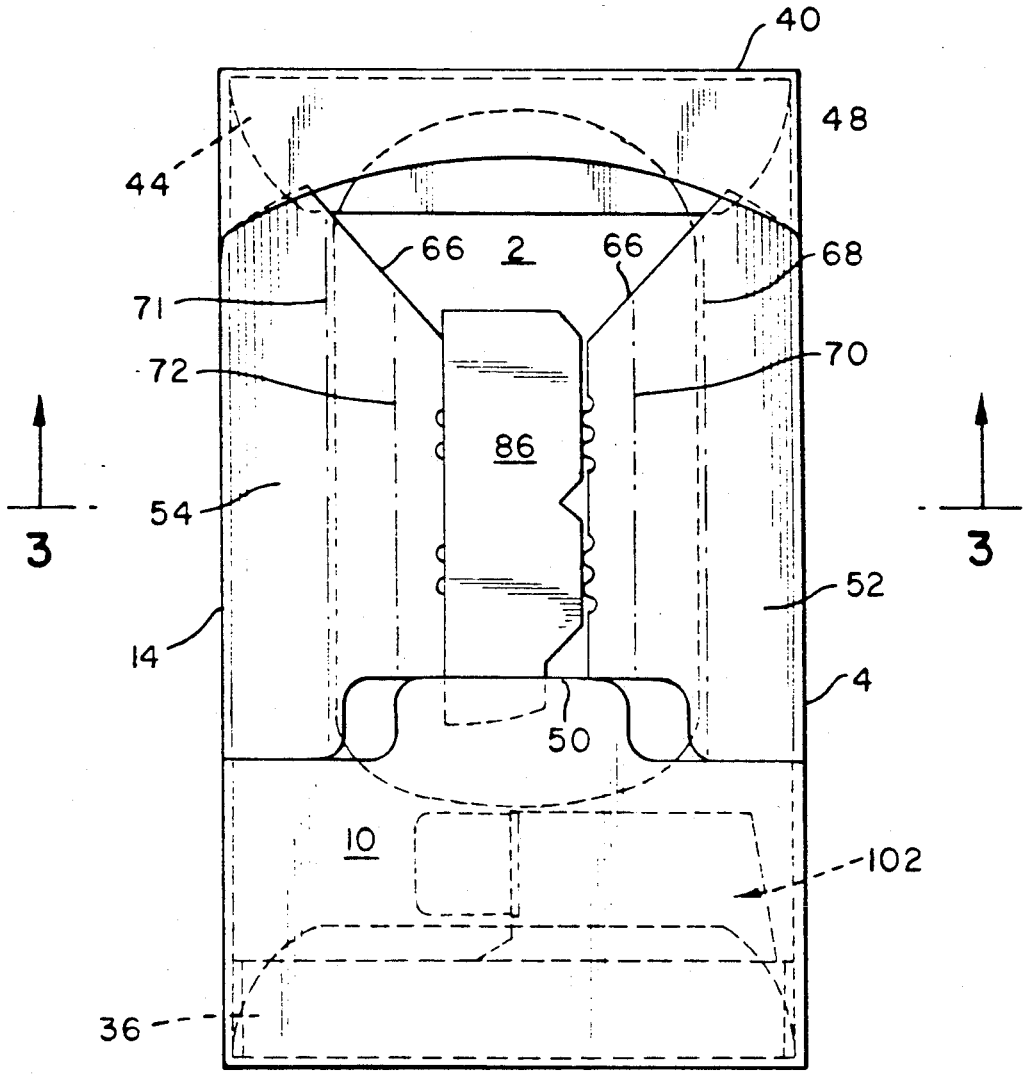
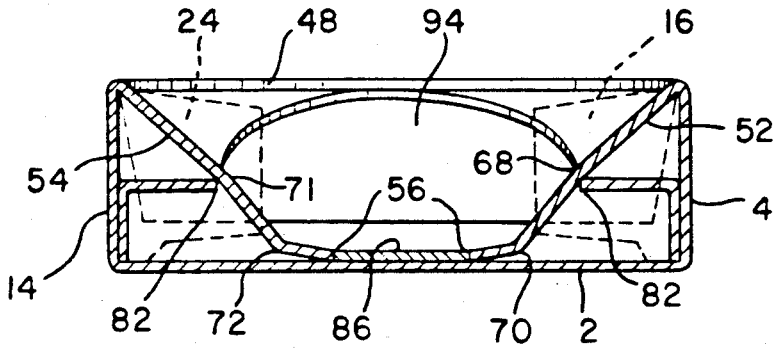
FIG. 3

REINFORCED DISPLAY BOX

The invention relates to a carton for displaying an object contained therewithin in which the size of the display opening is maximized without sacrificing the structural integrity of the container, the container having an object-receiving partition the position of which within the container is made structurally secure.

Containers for receiving an object and displaying the object through an opining in one of the container walls are in widespread use. Making the object visible within the container is a merchandising advantage, and in general the greater the area of visibility the greater is the merchandising advantage. Further, it is common in such containers to provide so-called shadow panels, usually inclined panels, against which the contained object is visible, usually in a contrasting fashion. Maximizing the area of the opening through which the object is visible is achieved by minimizing the amount of structural material remaining in the carton, but this constitutes a disadvantage of and limitation on maximizing the viewing opening. In addition, display cartons of the type under discussion are often provided with partitions designed to receive and hold the object to be displayed in desired position within the carton. It has proved difficult to provide means for locating the partition properly within the carton. Further, it is highly desirable, if not virtually essential from an economic point of view, that the cartons under discussion be formed from a single blank of material, thereby to minimize assembly and erection costs.

In accordance with the present invention the problems outlined above are solved in an exceptionally effective and economic manner. The width of the viewing opening in the top wall of the carton is maximized so as to correspond, if desired, to the full width of that top wall, yet the carton is rigidified and strengthened because the shadow panels are utilized as strengthening structural members. To that end they extend down to the bottom wall of the carton and that bottom wall is provided with shadow-panel-securing means against which edges of the shadow panels abut. Hence the shadow panels, while performing their conventional display function with full effectiveness, act structurally to reinforce the outer container walls and thus to render the container substantially as rigid and self-sustaining as if a display opening had not been formed in the top. In addition, the partition is provided with a foldable extension which, when appropriately folded into shape, defines a strut extending between the partition and the top or bottom wall of the container, thereby to hold the partition in position and at the same time further rigidify the top or bottom container wall which it engages. All of this is accomplished by structure which may be erected from a single paperboard blank provided with appropriate fold and cut lines, thus maximizing convenience and minimizing the cost of manufacture, shipping and erection.

It is therefore the prime object of the present invention to produce a display carton in which the object-retaining and -display features are maximized without sacrificing container rigidity.

It is another object of the present invention to use the shadow panel of the display carton to rigidify the carton, thereby substantially to compensate for any loss in rigidity arising from forming the viewing opening in the top wall of the carton.

It is another object of the present invention to provide a carton having simplified means active between an object-receiving partition in the top or bottom wall of the carton so as to fix the partition in position and rigidify it and the remainder of the carton.

It is a further object of the present invention to accomplish the above objectives through the use of a single easily erected blank.

To the accomplishment of the above, and to such other objects as may hereinafter appear, the present invention relates to the structure and arrangement of a display carton as defined in the appended claims and as described in this specification, in which:

FIG. 2 is a top plan view of the erected carton (but without the object to be displayed); and FIG. 3 is a cross-sectional view taken along the line 3—3 of FIG. 1.

Figure 1:
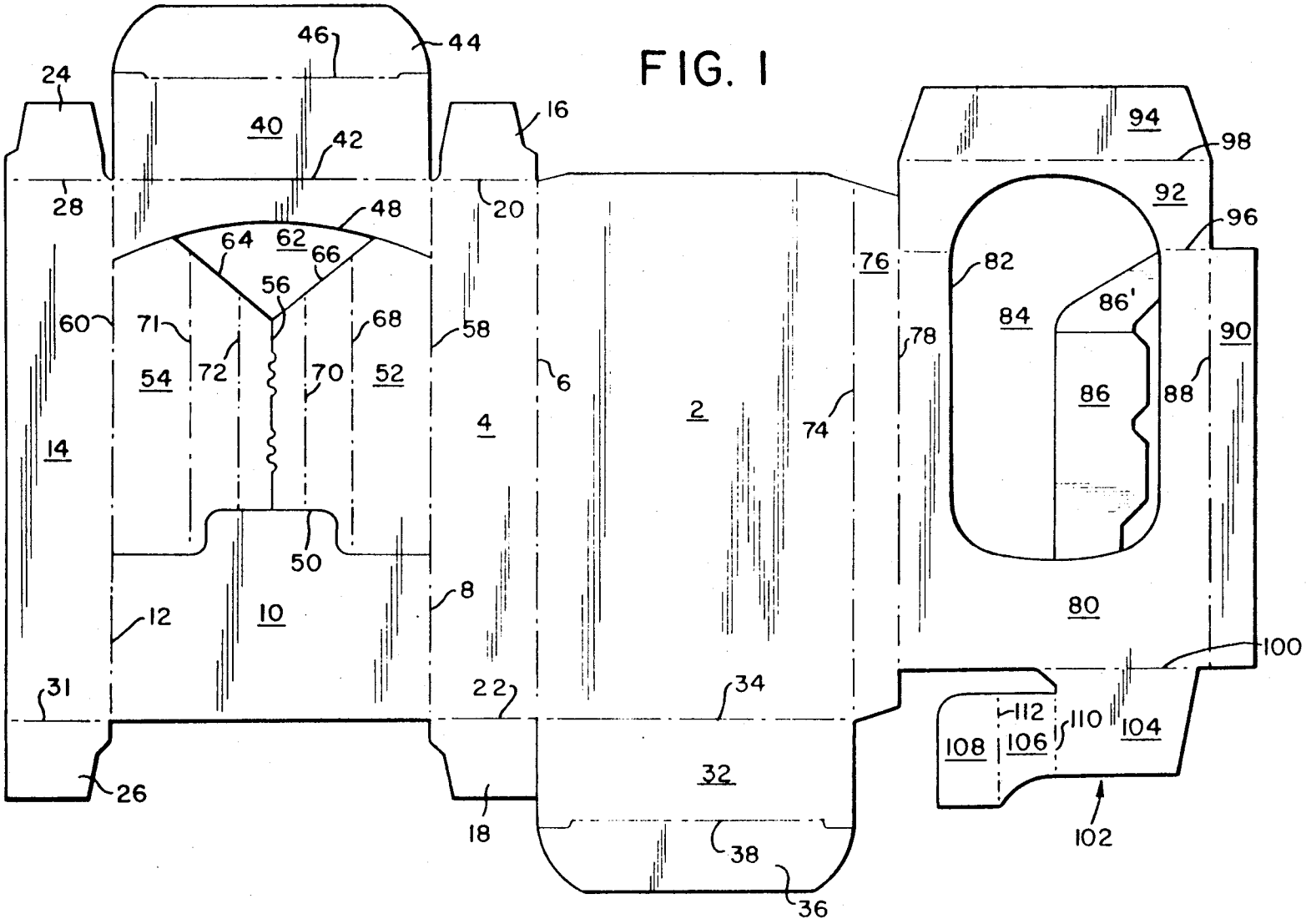
FIG. 1 is a top plan view of a blank from which the display carton of the present invention can be formed.

As is shown in FIG. 1, the display carton of the present invention is formed from a single blank of die-cut or otherwise formed carton material such as paperboard. The blank comprises a bottom wall panel 2 to which side wall panel 4 is connected by means of fold line 6. Fold line 8 connects side wall panel 4 to top wall panel 10, and fold line 12 connects top wall panel 10 to side wall panel 14. End flaps 16 and 18 are connected to side wall panel 4 by fold lines 20 and 22 respectively, and end flaps 24 and 26 are connected to side wall panel 14 by fold lines 28 and 30 respectively. End wall panel 32 is connected to one end of bottom wall panel 2 by fold line 34, and it has a flap 36 connected to it by fold line 38. End wall panel 40 is connected to one end of top wall panel 10 by fold line 42, and it has a flap 44 connected thereto by fold line 46. Cuts 48 and 50 are formed in the top wall panel 10, thereby to produce shadow panels 52 and 54 separated by cut 56 and extending to fold lines 58 and 60 respectively which, as here specifically disclosed, are in line with the fold lines 8 and 12 respectively. The material in space 62 bounded by a portion of the cut 48 and cuts 64 and 66 may be removed if desired. The distances between the cut 56 and the fold lines 58 and 60 respectively, defining what may be termed the length of the shadow panels 52 and 54, are considerably greater than the width of the side wall panels 4 and 14, the shadow panel 52 is provided with fold lines 68 and 70, and the shadow panel 54 is provided with fold lines 71 and 72.

The side of the bottom panel 2 opposite the fold line 6 is defined by fold line 74 to which the panel 76 is connected, that panel having a width approximately half the width of the side wall panels 4 and 14. It is connected by fold line 78 to partition panel 80, cut 82 forming in the partition panel 80 an object-receiving opening 84. Within that opening, and initially part of the blank, is a strip 86 which can readily be removed from the blank for a purpose hereafter to be explained. Fold line 88 connects flap 90 to the partition 80. The partition panel 80 includes panel portions 92 and 94 defined by fold lines 96 and 98. At the other end of the partition panel 80 from the panel portions 92 and 94 is a fold line 100 connecting to the partition panel 80 a foldable panel combination designated generally 102 and comprising sections 104, 106 and 108 connected by fold lines 110 and 112.

To convert the thus-described blank into a display container one first removes the strip 86 from the blank, excises the portion 86' therefrom and pastes or otherwise secures it to the upper surface of the bottom wall panel 2 centrally thereof. Thereafter, in the described sequence or otherwise, the partition panel 80 is moved over the bottom wall panel 2 by bending about the fold lines 74 and 78 and the flap 90 is bent up vertically. The side wall 4 is bent up around the fold line 6 and the flap 90 is adhesively secured to the upper portion thereof. The section 104 of the foldable panel combination 102 is bent to overlie the partition panel 80 and may be secured thereto by adhesive, the section 106 is bent vertically and the section 108 is bent out at right angles thereto. The top wall panel 10 is folded to overlie the partition 80 and to engage and be adhesively secured to the panel section 108, and the end wall panel 14 is bent down to engage and be adhesively secured to the panel 76. The shadow panels 52 and 54 are then bent down through the space 84 in the partition panel 80, and the free portions of the shadow panels 52 and 54 are then bent around the fold lines 68, 70, 71 and 72 so that the edges of those shadow panels defined by the cut 56 abut against the exposed edges of the strip 86, as may best be seen from FIGS. 2 and 3. The carton is then ready for receiving the object which it is designed to display, that object being insertable through an open end of the carton so as to overlie the shadow panels 52 and 54, be received in the opening 84 in the partition 8, and be exposed through the opening in the top wall panel 10 produced by bending the shadow panels out therefrom. The ends of the carton may then be closed in conventional fashion by appropriate folding and insertion of the flaps 16, 18; 24, 26; panel 32 and flap 36; and panel 40 and flap 44. The panel portion 92 of the partition panel 80 is inclined upwardly toward and into engagement with the top wall panel 10, and the flap 94 is folded against, and, if desired, adhesively secured to, the inner surface of the flap 40.

It will be noted that the width of the display opening extends the full width of the top wall panel 10. Under normal circumstances this would make the side wall panels of the carton very weak. However, because the shadow panels 52 and 54 extend from the upper edges of the side walls 4 and 14 and edges of those shadow panels abut against the exposed edges of the strip 86, the shadow panels 52 and 54 themselves define structural reinforcements positively inhibiting collapse of the side wall panels 4 and 14, thus rigidifying the carton while at the same time maximizing the display feature thereof. In addition, the partition panel 80 is positively and reliably located within the carton, the section 106 of the foldable panel combination 102 defining a rigidifying strut between the partition 80 and the top wall panel 10 near one end of the partition 80, the other end of the partition 80 preferably being fixed in place by engagement of the flap 94 with the end wall flap 40. As will be apparent from the above, the desirable display and structural attributes are achieved by a structure formed from a single blank of suitable carton material.

While but a single embodiment of the present invention has been here specifically disclosed, it will be apparent that that is by way of exemplification only, and many detail variations may be made therein, all within the scope of the invention as defined in the following claims.

I claim:

1. In a display carton comprising bottom, top and side walls defining between themselves an object-receiving space, said top wall having an opening through which an object received in said space can be viewed, the improvement which comprises shadow panels extending down from said top wall and inclined toward one another, and shadow-panel-securing means on said bottom wall separate from and normally unconnected to said shadow panels, said shadow panels engaging said securing means when said shadow panels are in operative position, whereby said shadow panels are secured in their inclined position and support the top wall and said side walls.

2. The display carton of claim 1, in which said shadow panels have end edges and in which said panel-securing means comprises a raised portion on said bear.

3. The display carton of claim 2, in which said raised portion comprises a length of material fastened to the upper surface of said bottom wall and having exposed side edges against which said shadow panel end edges bear.

4. The display carton of claim 3, in which said carton is formed from a single blank of carton material, said length of material at least initially being part of said blank.

5. In the display carton of any of claims 1–3, a partition located between and spaced from said bottom and top walls and having an object-receiving opening at least in part registering with said top wall opening.

6. The display carton of claim 5, in which said carton, including said partition, is formed from a single blank of carton material, said length of material initially being part of said blank and removably located within that part of said blank which defines said object-receiving opening in said partition.

7. In a display carton comprising bottom, top and side walls defining between themselves an object-receiving space, said top wall having an opening through which sn object received in said space can be viewed, the improvement which comprises a partition located between and spaced from said bottom and top walls and having an object-receiving opening at least in part registering with said top wall opening, said partition having side edges and an end edge and being foldably connected along said side edges to panels which engage and are secured to said carton side walls and foldably connected along one of its end edges to a foldable panel combination defining a supporting strut extending between and fixed to said partition and one of said bottom and top walls, and in which said foldable panel combination comprises a first section folded to lie along said partition, a second section extending substantially perpendicularly from said first section up to said one of said bottom and top walls, and a third section foldably connected to said second section and engaging and lying along said one of said bottom and top walls.

8. The display carton of either of claim 7, in which said partition is foldably connected along the other of its end edges to a panel extending substantially to one of said bottom and top walls and having an object-receiving opening therein communicating with the object-receiving opening in said partition.

9. In the display carton of claim 8, said carton having end walls, said panel of claim 8 reaching one of said end walls and having a flap foldably secured thereto and engaging and extending along said one of said end walls.

10. In the display carton of either of claim 7 shadow panels extending down from said top wall inclined toward one another, and shadow-panel-securing means on said bottom wall, said shadow panels engaging said securing means, whereby said shadow panels are secured in their inclined position and support said top wall and said side walls.

11. The display carton of claim 10, in which said shadow panels have end edges and in which said panel-securing means comprises a raised portion on said bottom wall against which said shadow panel end edges bear.

12. The display carton of claim 11, in which said raised portion comprises a length of material fastened to the upper surface of said bottom wall and having exposed side edges against which said shadow panel end edges bear.

13. The display carton of claim 12, in which said carton is formed from a single blank of carton material, said length of material at least initially being part of said blank.

14. The display carton of claim 13, in which said length of material is initially part of said blank and is removably located within that part of said blank which defines said object-receiving opening in said partition.

15. In a display carton comprising bottom, top and side walls defining between themselves an object-receiving space, said top wall having an opening through which an object received in said space can be viewed, the improvement which comprises a partition located between and spaced from said bottom and top walls and having an object-receiving opening at least in part registering with said top wall opening, said partition having side edges and an end edge and being foldably connected along said side edges to panels which engage and are secured to said carton side walls and foldably connected along one of its end edges of a foldable panel combination defining a supporting strut extending between and fixed to said partition and one of said bottom and top walls, in which said partition is foldably connected along the other of its end edges to a panel extending substantially to one of said bottom and top walls and having an object-receiving opening therein communicating with the object-receiving opening in said partition, and in which said carton has end walls, said panel reaching one of said end walls and having a flap foldably secured thereto and engaging and extending along said one of said end walls.

16. In a display carton comprising bottom, top and side walls defining between themselves an object-receiving space, said top wall having an opening through which an object received in said space can be viewed, the improvement which comprises a partition located between and spaced from said bottom and top walls and having an object-receiving opening at least in part registering with said top wall opening, said partition having side edges and an end edge and being foldably connected along said side edges to panels which engage and are secured to said carton side walls and foldably connected along one of its end edges to a foldable panel combination defining a supporting strut extending between and fixed to said partition and one of said bottom and top walls, shadow panels extending down from said top wall inclined toward one another, and shadow-panel-securing means on said bottom wall, said shadow panels engaging said securing means, whereby said shadow panels are secured in their inclined position and support said top wall and said side walls.

17. The display carton of claim 11, in which said shadow panels have end edges and in which said panel-securing means comprises a raised portion on said bottom wall against which said shadow panel end edges bear.

18. The display carton of claim 17, in which said raised portion comprises a length of material fastened to the upper surface of said bottom wall and having exposed side edges against which said shadow panel end edges bear.

19. The display carton of claim 18, in which said carton is formed from a single blank of carton material, said length of material at least initially bearing part of said blank.

20. The display carton of claim 19, in which said length of material is initially part of said blank and is removably located within that part of said blank which defines said object-receiving opening in said partition.

21. In a display carton comprising bottom, top and side walls defining between themselves an object-receiving space, said top wall having an opening through which an object received in said space can be viewed, the improvement which comprises shadow panels extending down from said top wall and inclined toward one another, and shadow-panel-securing means on said bottom wall, said shadow panels engaging said securing means, whereby said shadow panels are secured in their inclined position and support the top wall and said side walls, and a partition located between and spaced from said bottom and top walls and having an object-receiving opening at least in part registering with said top wall opening.

22. The display carton of claim 21, in which said shadow panels have end edges and in which said panel-securing means comprises a raised portion on said bottom wall against which said shadow panel end edges bear.

23. The display carton of claim 22, in which said raised portion comprises a length of material fastened to the upper surface of said bottom wall and having exposed side edges against which said shadow panel end edges bear.

24. The display carton of said claim 21, in which said carton, including said partition, is formed from a single blank of carton material, said length of material initially being part of said blank and removably located within that part of said blank and removably located within that part of said blank which defines said object-receiving opening in said partition.

* * * * *